United States Patent [19]

Clayton

[11] Patent Number: 4,953,481

[45] Date of Patent: Sep. 4, 1990

[54] METHOD FOR CONTROL OF SLAG BUILD-UP IN SOLID WASTE INCINERATORS

[75] Inventor: Dennis A. Clayton, Stanchfield, Minn.

[73] Assignee: Utility Chemicals, Inc., Cambridge, Minn.

[21] Appl. No.: 401,761

[22] Filed: Sep. 1, 1989

[51] Int. Cl.[5] ..... F23B 7/00

[52] U.S. Cl. ..... 110/342; 110/343; 110/346

[58] Field of Search ..... 110/342, 343, 344, 345, 110/346; 431/4

[56] References Cited

U.S. PATENT DOCUMENTS

| | | | |
|---|---|---|---|
| 4,352,747 | 10/1982 | Every et al. | 110/342 |
| 4,372,227 | 2/1983 | Mahoney et al. | 110/342 |
| 4,377,118 | 3/1983 | Sadowski | 110/342 |
| 4,428,310 | 1/1984 | Kekish et al. | 110/344 |
| 4,450,777 | 5/1984 | Wolfrum et al. | 110/342 |
| 4,498,402 | 2/1985 | Kober et al. | 110/344 |
| 4,514,256 | 4/1985 | Kober et al. | 110/343 |
| 4,596,198 | 6/1986 | Greskovich et al. | 110/342 |
| 4,796,548 | 1/1989 | Merrell et al. | 110/343 |

*Primary Examiner*—Edward G. Favors
*Assistant Examiner*—Denise L. Ferensic
*Attorney, Agent, or Firm*—Burd, Bartz & Gutenkauf

[57] ABSTRACT

The invention is directed to the use of melting point enhancers to control slag build-up in garbage, medical waste and sludge incinerators. It is directed to a method of modifying the nature of low melting non-combustible components of garbage, medical waste and sludge by the addition of very high melting point metallic compounds so as to render the low melting point materials non adherent or less adherent and easier to remove from furnace surfaces.

11 Claims, No Drawings

METHOD FOR CONTROL OF SLAG BUILD-UP IN SOLID WASTE INCINERATORS

FIELD OF THE INVENTION

BACKGROUND OF THE INVENTION

This invention relates to a method for controlling the build-up of slag on the interior walls of incinerators during operation for burning garbage, medical wastes, sewer disposal plant sludge, and similar waste materials. More particularly, the invention relates to the method of controlling slag build-up in waste burning incinerators, including medical waste burners, and the like, by the addition of a melting point enhancing agent to the waste material to be burned.

With the ever increasing volume of solid waste being generated by the citizenry in the course of daily living, the diminishing availability of land-fill area for disposal, and enhanced concern about the long-term environmental effects of land-fill disposal, the problem of disposition of solid waste has reached caustic proportions. Disposal of medical wastes present particular problems for the avoidance of health hazard. More and more incineration is being looked upon as the preferred method of disposal. It is environmentally sound. Incinerators may be located close to the source of waste. The heat produced may be sold, or utilized to generate electricity for which there is a ready market, to reduce the cost of waste disposal.

However, it has been found that a tenaciously adhering glossy slag quickly builds up on the inside walls of the combustion chamber. Dependent upon the nature of the waste being burned, slag formation commonly results during one to two weeks of normal operation. Metal contaminants, such as aluminum, silicon and sodium, oxidize in the burning process forming compounds whose melting points are less than the temperatures required by law to be maintained to assure destruction of dioxins. These molten oxides reach the cooler furnace surfaces, solidify, and form tightly bound slag which chokes off the furnace and requires shut-down of the incinerator. Harsh and expensive cleaning procedures are needed to remove the slag before normal operation can be resumed.

THE PRIOR ART

Attempts have been made to install soot-blowers to reduce slagging. Additional techniques tried have included tighter temperature control, flue gas recycling, and fuel segregation with limited success. The problem appears to be prevalent to varying degrees in all units depending on the type of incinerator unit, the nature of the fuel and method of feeding, design of the heat recovery system, fuel addition rate control, and the like.

SUMMARY OF THE INVENTION

It has been discovered that adding very high melting point compounds containing calcium, magnesium, and aluminum to the fuel or furnace burning chamber causes in situ alloying with the low melting ash, creating a friable and easily removable residue. Broadly stated, the invention comprises the method of controlling slag build-up in waste burning incinerators which comprises adding to the combustion chamber per ton of waste fuel from about ½ to 5 pounds of a melting point enhancing material comprised of high melting point compounds of calcium, magnesium or aluminum, and mixtures thereof.

DETAILED DESCRIPTION OF THE PREFERRED EMBODIMENT

The present invention is directed to a method for the control of slag build-up in garbage and sludge incinerators using melting point enhancers. The method is used upon the modification of the nature of low melting non-combustibles in garbage, such as cans and bottles, and sludge so as to render them non-adherent or less adherent and easier to remove from furnace surfaces, especially in the waste heat recovery unit of the incinerator. The method involves the selection and proper addition of a very high melting point metallic compound, such as magnesium oxide, calcium carbonate, calcium oxide, aluminum oxide, and the like, and combinations thereof, to the burning waste so as to increase the melting point of the resulting ash above the furnace temperature a sufficient amount to cause it to solidify before contacting the surface.

Normal operating temperatures of waste incinerators are typically between about 1800° to 2300° F. with occasional spikes or excursions up to about 2150° to 2500° F. The operative metallic additives are those compounds with melting points above the normal furnace operating temperatures. Approximate melting points of exemplary additives are: Magnesium oxide, 5166° F.; Calcium carbonate (calgite), 2442° F.; Calcium oxide, 4737° F.; Aluminum oxide, 3762° F.; and Calcium orthophosphate (Bone ash), 3038° F. Preferred additives are abundant, low-cost, naturally occurring minerals which form ash which is environmentally-safe, and can be legally disposed of in landfills, and as filler and aggregate, and the like.

Proper additive selection involves first sampling and analyzing the existing ash to determine the major low melting components. The operating furnace temperatures are reviewed to establish how much melting point increase will be needed to accomplish desired results. This and economics in turn dictate the type, amount, and ratio of compounds to be used.

The objective is to convert the lower melting point slag forming materials in the waste stream into compounds whose melting points are greater than the highest temperatures attained in the waste burning furnace, at the lowest possible cost. This higher melting point ash falls to the bottom of the furnace and is recovered, or is carried from the furnace with the exhaust gases and separated. In some instances the ash may be loosely deposited in granular form in exhaust conduits, but this granular material is easily removed by raking or by blasting with compressed air. Because the composition of the waste fuel stream varies widely, typically from 1 to 30% non-combustibles and varying in composition, approximations necessarily must be made of the amount of additive to be introduced to the combustion zone. To insure substantially complete conversion of the slag-forming ash, an excess of additive is used over the estimated average stoichiometric amount required to achieve the conversion. Test burns may be made to determine the approximate analysis of the waste and its slag-forming constituents. To a large degree the determination of the amount and kind of additive is necessarily a trial and error procedure due to the wide variation in operating conditions, equipment used, source and consistency of the waste, and the like. Each waste burning installation presents unique problems to be solved. Essentially low melting point sodium, silicon and aluminum compounds are converted into higher melting point calcium, magnesium and aluminum compounds.

The type of furnace design and location of the slag deposits are reviewed to determine the type of feed system required, addition frequency, degree of compound reactivity needed, and grain size of the products to be added. Since waste and sludge are being treated, the exact amount and type of non-combustibles to be treated cannot be determined in advance. Instead, the additive rate is approximated by establishing the dry weight ratio between ash remaining after combustion versus fuel burned. With this and the amount of each low melting component in the analyzed ash, a beginning feed rate can be established.

The ash fusion temperature of untreated ash is next measured. Varying combinations and amounts of several high melting compounds are added. The increase in ash fusion temperature versus type and amount of additive are measured. This establishes the proper rate, type and ratio to be used.

When a unit with only a primary burning chamber is being treated, large (50–100 mesh) low reactive less costly additive is used. The product may be added by hand or through an auger type feeder directly to the fuel as it enters the furnace, generally at a rate of about ½ to 5 pounds of additive compound per ton of waste fuel. Better contact is achieved when the additive may be blown into the combustion zone, requiring less additive. Similarly, fine mesh additive is more reactive and may be used in lesser amounts.

When treating a two chamber or starved air unit, it is first determined if a problem exists only in the secondary chamber or in both the primary and secondary burning zones. In cases when only the secondary or excess air chamber shows evidence of slagging, the treatment utilizes a high reactivity fine (325 mesh) calcium carbonate—magnesium oxide mixture, plus a 50 mesh aluminum oxide blended in a ratio of about 2:1:1 to 1:2:1. This additive blend is injected directly to the secondary flame zone using a pneumatic injection system. The high reactivity is required because contact time in these units is short. Fine mesh calcium carbonate—magnesium oxide is used to facilitate pneumatic injection. Aluminum oxide serves two purposes. First it acts as a transport agent to assure the fine powder doesn't plug the feeder and second it offers a very high melting component to further accelerate the ash fusion temperature. While aluminum oxide is technically a good additive and its use is most cost effective, environmental concerns may inhibit its use because landfill disposal of ash high in aluminum is generally impermissible. On the other hand, if the ash is to be used as aggregate, aluminum oxide is a preferred additive.

Fine tuning the additive feed rate and ratio is determined by (a) treated ash analysis, (b) economics, and (c) cleanliness and cleanability of the treated furnace. The ultimate objective is to convert the low melting ash into a friable high melting particulate which is non-adherent, or only lightly adherent to the furnace walls so that it is easily removed. This objective is to be met at the lowest possible cost.

The invention is further illustrated by the following examples:

EXAMPLE 1

The Pope Douglas Waste To Energy Facility in Alexandria, Minn. encountered several different operating problems, one of which was primary furnace slagging which required mechanical cleaning using air hammers and chisels every 15 to 20 days. The furnace operating temperature was 1800° to 2000° F., with peaks to 2150° F. Ash was analyzed and found to be 25% sodium oxide and 55% aluminum silicate with an ash fusion temperature of 1850° F. Various ratios of magnesium oxide and calcium carbonate were tested. It was found that a 2:1 ratio of coarse (50 mesh) low reactivity added at a rate of 1 pound of the 2:1 ratio product per ton of trash burned was effective. The dry weight reduction (trash to ash) was 6:1. Since this is a Kadoux Batch fed, single furnace design the decision was made to hand feed the additive by sprinkling quarter pound batches of additive on each 500 pound dump of trash before it was dumped into the burning chamber.

In a period of 24 hours the slag turned to ash. In this form it did not adhere to the furnace walls but instead fell to the floor of the furnace and was removed through the ash handling system or eliminated with soot blowers and collected in the electrostatic precipitators. Analysis of the treated ash showed the melting point had increased to 2150° F. and the calcium and magnesium content increased to 14% and 38%, respectively.

EXAMPLE 2

The American Resource Recovery plant in New Richmond, Wis. uses three single chamber batch fired units with a bag house for flue gas treatment. The unit had been in operation about a year with cleaning required every 12 to 15 days. Inspection of the throat leaving the combustion chamber showed very severe slagging. This throat when clean measures 27" high by 48" wide. At the time of inspection the opening measured 9" high by 28" side at the narrowest passage. Slag analysis showed primarily sodium oxide and aluminum silicate with a melting point of 1950° F. Review of operating temperatures showed spikes up to 2150°–2200° F. Since this is another single chamber unit and it was desired to achieve approximately the same increase in ash melting temperature as in Example 1, the same product ratio and treatment rate was repeated. Treatment was initiated on a Friday by sprinkling ⅓ pound of additive composed of a coarse (50 mesh) magnesium oxide and calcium carbonate in a 2:1 ratio on each 650 pound load of trash just prior to dropping it into the combustion chamber. By Monday the plant reported the slag turned to ash and was easily "raked" off the furnace throat without sticking. The treated ash fusion temperature was found to be 2150° F. with (20%) calcium and (35%) magnesium reflecting that alloying was actually taking place.

EXAMPLE 3

The Olmstead County incinerator in Rochester, Minn. is a two chamber starved air Riley designed unit utilizing continuous hopper feed trash addition, which encountered slagging problems requiring mechanical cleaning approximately every 2 to 3 weeks. Initial ash fusion temperature was 1900° F. with analysis showing the slag as containing primarily about 6% sodium oxide, 18% aluminum silicate and calcium sulfate, 57%. Normal operating temperatures were 1950° to 2000° F. with excursions up to 2150° F., the lower temperatures resulting from more uniform fuel addition rate. The treatment utilized a two component additive (calcium carbonate, magnesium oxide) in the ratio 1:2 with auger dispensed pneumatic injected feed directly to the secondary flame zone, at a rate of 1 pound per ton of waste fuel. Granular ash deposits built up but these were easily removed with blasts of compressed air.

It is apparent that many modifications and variations of this invention as hereinbefore set forth may be made without departing from the spirit and scope thereof. The specific embodiments described are given by way of example only and the invention is limited only by the terms of the appended claims.

I claim:

1. The method of controlling slag build-up in waste burning incinerators, which comprises adding to the burning waste in the combustion zone of the combustion chamber of the primary incinerator per ton of waste fuel about ½ to 5 pounds of a melting point enhancing particulate material comprised of a mixture of magnesium oxide and calcium carbonate in the ratio of 2:1 to 1:2, and having a particle size between about 50 and 500 mesh, sufficient to raise the melting point of slag-forming ash above the highest operating temperature of the incinerator.

2. The method of claim 1 wherein said mixture is introduced directly into the combustion zone of the combustion chamber.

3. The method of claim 1 wherein said mixture is added to the waste fuel prior to introduction into the combustion chamber.

4. The method of controlling slag build-up in waste burning incinerators which comprises:

(A) determining the approximate composition and melting point of slag formed in the incinerator, and (B) adding to the burning waste in the combustion zone of the combustion chamber per ton of waste fuel from about ½ to 5 pounds of a melting point enhancing particulate material having a particle size between about 50 and 350 mesh and comprised of high melting point compounds having melting points higher than about 2400° F. of a metal selected from the group consisting of calcium, magnesium and aluminum, and mixtures thereof, sufficient to raise the melting point of slag-forming ash above the highest operating temperature of the incinerator.

5. The method of claim 4 wherein said high melting point compounds are introduced directly into the combustion zone of the combustion chamber.

6. The method of claim 4 wherein said high melting point compounds are added to the waste fuel prior to introduction into the combustion chamber.

7. The method of claim 4 wherein said high melting point compounds are selected from the group consisting of calcium carbonate, calcium oxide, calcium orthophosphate, magnesium oxide and aluminum oxide, and mixtures thereof.

8. The method of claim 4 wherein said high melting point compounds comprise a mixture of magnesium oxide and calcium carbonate in the ratio of from 2:1 to 1:2.

9. The method of claim 4 wherein said high melting point compounds:

(A) are introduced into the primary incinerator, (B) comprise a mixture of magnesium oxide and calcium carbonate in the ratio of 2:1 to 1:2, and (C) have a particle size between about 50 and 100 mesh.

10. The method of claim 4 wherein said high melting point compounds:

(A) are introduced into the secondary or excess air chamber of a two chamber incinerator, (B) comprise a mixture of magnesium oxide and calcium carbonate in the ratio of 2:1 to 1:2 having a particle size between about 300 and 350 mesh, and (C) include aluminum oxide having a particle size between about 50 and 100 mesh in the ratio of about ⅓:1 relative to said magnesium oxide-calcium carbonate mixture.

11. The method of controlling slag build-up in waste burning incinerators, which comprises adding to the burning waste in the combustion zone of the secondary or excess air chamber of a two chamber incinerator per ton of waste fuel about ½ to 5 pounds of a melting point enhancing particulate material comprised of a mixture of magnesium oxide and calcium carbonate in the ratio of 2:1 to 1:2 having a particle size between about 300 and 350 mesh, and including aluminum oxide having a particle size between about 50 and 100 mesh in the ratio of about ⅓:1 relative to said magnesium oxide-calcium carbonate mixture, sufficient to raise the melting point of slag-forming ash above the highest operating temperature of the incinerator.

* * * * *

UNITED STATES PATENT AND TRADEMARK OFFICE

CERTIFICATE OF CORRECTION

PATENT NO. : 4,953,481

DATED : September 4, 1990

INVENTOR(S) : DENNIS A. CLAYTON

It is certified that error appears in the above-identified patent and that said Letters Patent is hereby corrected as shown below:

Column 1, line 22, "caustic" should be --- crisis ---.

Column 1, line 23, "present" should be --- presents ---.

Column 1, line 24, "hazard" should be --- hazards ---.

Column 4, line 34, "side" should be --- wide ---.

Column 5, line 18, "500" should be ---100---.

Signed and Sealed this

Tenth Day of March, 1992

*Attest:*

HARRY F. MANBECK, JR.

*Attesting Officer*

*Commissioner of Patents and Trademarks*